US006537084B2

(12) United States Patent
Casey et al.

(10) Patent No.: US 6,537,084 B2
(45) Date of Patent: Mar. 25, 2003

(54) ELECTRICAL CONNECTOR WITH ELECTRICAL SHIELD HAVING LATCH AND MOUNTING ARMS

(75) Inventors: Daniel T. Casey, Harrisburg, PA (US); George I. Peters, Jr., Harrisburg, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/410,004

(22) Filed: Sep. 30, 1999

(65) Prior Publication Data

US 2001/0049209 A1 Dec. 6, 2001

(51) Int. Cl.[7] ..... H01R 12/00
(52) U.S. Cl. ..... 439/76.1; 439/108
(58) Field of Search ..... 439/55, 76.1, 607, 439/638, 939, 79, 609, 95, 108

(56) References Cited

U.S. PATENT DOCUMENTS

| | | | | |
|---|---|---|---|---|
| 5,496,195 A | | 3/1996 | Reed | 439/607 |
| 5,637,014 A | | 6/1997 | Sukegawa et al. | 439/607 |
| 5,940,275 A | * | 8/1999 | Laity | 361/737 |
| 5,984,726 A | * | 11/1999 | Wu | 439/607 |
| 6,033,265 A | * | 3/2000 | Yeh | 439/638 |
| 6,159,023 A | * | 12/2000 | Lai | 439/79 |
| 6,290,513 B1 | * | 9/2001 | Kakinoki et al. | 439/108 |
| 6,319,060 B1 | * | 11/2001 | Wu | 439/108 |
| 6,322,392 B1 | * | 11/2001 | Wang | 439/101 |

FOREIGN PATENT DOCUMENTS

| | | |
|---|---|---|
| EP | 0 584 937 B1 | 4/1998 |
| EP | 0 827 239 A2 | 4/1998 |
| EP | 0 893 854 A2 | 1/1999 |

OTHER PUBLICATIONS

Internet web site printout, "Straddle Mount HSSDC Receptacle" AMP Inc., 3 pages, Sep. 28, 1999.

* cited by examiner

*Primary Examiner*—P. Austin Bradley
*Assistant Examiner*—Edwin A. León
(74) *Attorney, Agent, or Firm*—Harrington & Smith, LLP

(57) ABSTRACT

An electrical connector is provided including a housing adapted to receive a portion of a printed circuit board; an electrical contact connected to the housing; and an electromagnetic interference (EMI) shield connected to the housing. The shield includes a front end with a hole for passage of a mating electrical connector through the front end into a receiving area of the housing. The shield further includes a spring finger extending into the hole and a first arm which extends from a rear end of the shield. The arm retains the shield on the housing and is adapted to hold the printed circuit board relative to the housing.

2 Claims, 3 Drawing Sheets

ELECTRICAL CONNECTOR WITH ELECTRICAL SHIELD HAVING LATCH AND MOUNTING ARMS

BACKGROUND OF THE INVENTION

1. Field of the Invention

The present invention relates to electrical connectors and, more particularly, to an electrical connector with a shield having a latch and mounting arms.

2. Brief Description of Earlier Developments

U.S. Pat. No. 5,865,646 discloses a connector shield with an integral latching and ground structure. Problems with conventional electrical connectors include incomplete shielding around a connector and latch mechanisms which do not provide electromagnetic shielding. Conventional electrical connectors do not provide complete shielding around the connector. Latch mechanisms are not necessarily part of the shield and, therefore, can interrupt shielding. Problems can be encountered with assembly of a convention connector with a printed circuit board. Positioning and holding together the printed circuit board to the connector at precise positions for soldering of contacts can be problematic.

The present invention can provide complete shielding around the connector. The latch mechanism can be provided as part of the shield and can enhance the shield effectiveness of the connector. The shield can be designed with a pair of arms which extend out the back of the connector to position and hold together the printed circuit board to the connector. Extensions off of the arms can also allow for an internal electrical ground on a module if required.

SUMMARY OF THE INVENTION

In accordance with one embodiment of the present invention, an electrical connector is provided comprising a housing adapted to receive a portion of a printed circuit board; an electrical contact connected to the housing; and an electromagnetic interference (EMI) shield connected to the housing. The shield comprises a front end with a hole for passage of a mating electrical connector through the front end into a receiving area of the housing. The shield further comprises a spring finger extending into the hole and a first arm which extends from a rear end of the shield. The arm retains the shield on the housing and is adapted to hold the printed circuit board relative to the housing.

In accordance with another embodiment of the present invention, an electronic component assembly comprising a printed circuit board having a contact area and at least one mounting notch; and an electrical connector connected to the printed circuit board. The connector comprises a housing having a plug receiving area; an electrical contact connected to the housing and electrically connected to the contact area on the printed circuit board; and an electrical shield connected to the housing. The shield comprises a spring finger extending into the plug receiving area and at least one arm which extends from a rear end of the shield to retain the shield on the housing. The arm projects into the mounting notch of the printed circuit board.

In accordance with another embodiment of the present invention, an electrical connector is provided comprising a housing having at least one side recess; an electrical contact mounted to the housing; and an electrical shield connected to the housing. The shield comprises a front with a hole for a mating connector to pass though and at least one side with a spring latch. The spring latch is located at the side recess. A portion of a component cover is insertable into the side recess and latched to the electrical connector by the side spring latch. The side spring latch provides shielding at the side recess.

In accordance with another embodiment of the present invention, an electronic component assembly is provided comprising a printed circuit board; an electrical connector connected to the printed circuit board; and a cover connected to the electrical connector and surrounding the printed circuit board. The connector comprises a housing and an electrical shield connected to the housing. The housing comprising a receiving area for receiving a mating electrical connector. The shield has a spring finger extending into the receiving area and a side latch. The side latch of the shield latches the cover to the electrical connector and electrically connects the shield to the cover.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
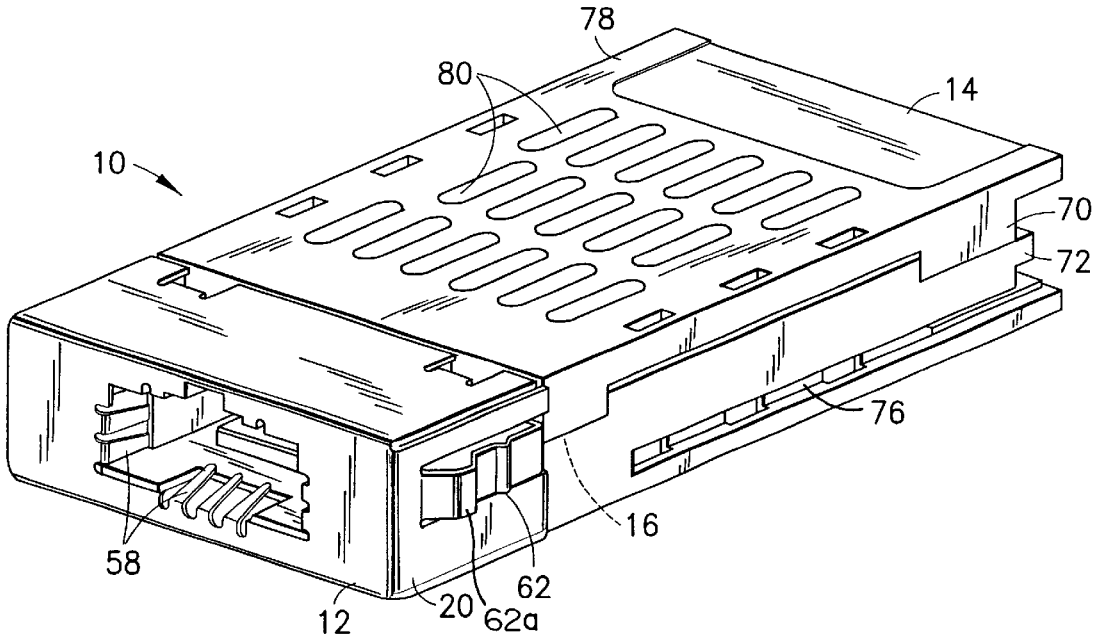
FIG. 1 is a perspective view of an electronic component assembly incorporating features of the present invention.

Referring to FIG. 1, there is shown a perspective view of an electronic component assembly 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
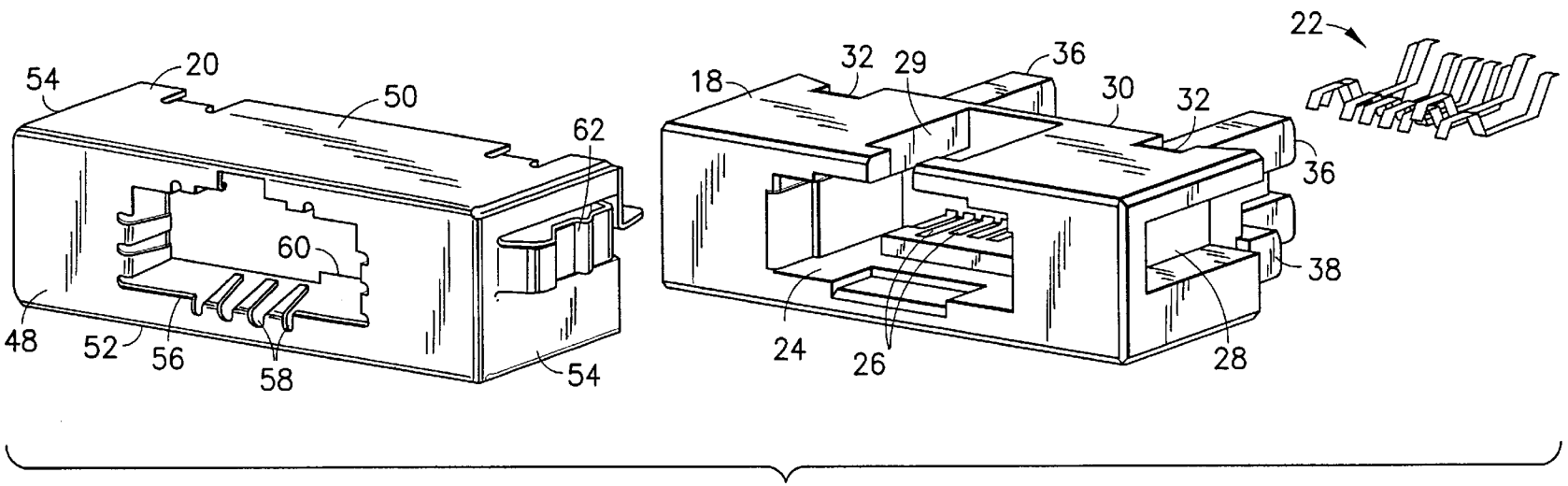
FIG. 2 is an exploded perspective view of the electrical connector of the assembly shown in FIG. 1.
Figure 3:
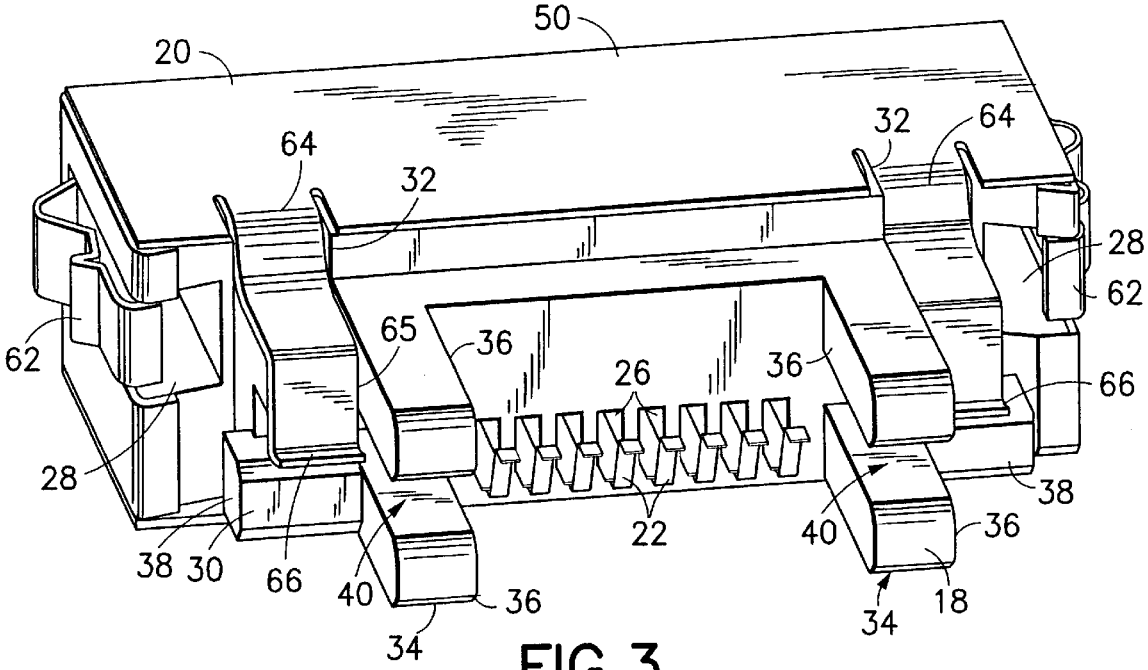
FIG. 3 is a rear end perspective view of the electrical connector shown in FIG. 2.

The assembly 10 generally comprises an electrical connector 12, a cover 14, and a printed circuit board 16. The connector 12 can have features similar to those described in U.S. Pat. No. 5,865,646 which is hereby incorporated by reference in its entirety. The printed circuit board 16 is connected to the connector 12 and is substantially surrounded by the cover 14. The board 16 includes suitable circuitry (not shown) and components (not shown) thereon. For example, the board 16 could have one or more integrated circuits, resistors, capacitors, etc. (not shown) to perform a given task(s) However, the electrical connector of the present invention could be used with additional or alternative components. Referring also to FIGS. 2 and 3, the connector 12 generally comprises an insulative housing 18, a conductive shield 20 and electrical contact terminals 22. The connector 12 is adapted to receive a mating electrical connector similar to the plug connectors also disclosed in U.S. Pat. No. 5,865,646.

Figure 4:
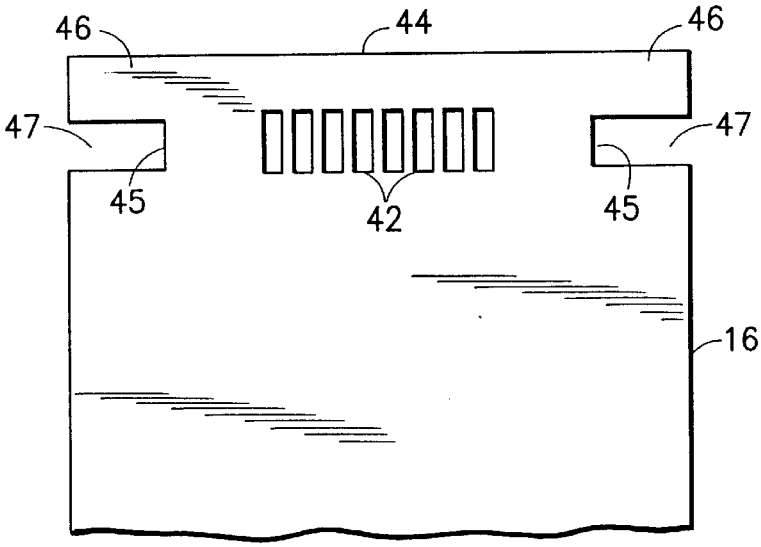
FIG. 4 is a schematic bottom plan view of the printed circuit board used in the assembly shown in FIG. 1.

The housing 18 is preferably a one-piece molded plastic member, but could be comprised of multiple members. The housing 18 comprises a plug receiving area 24 at a front face, a rear end 30, contact channels 26 extending from area 24 to rear end 30, side recesses 28, and a top opening 29 that accepts the plug latch. The rear end 30 includes top recesses 32, two pairs 34 of support legs 36, and lateral support extensions 38. The legs 36 form a receiving area 40 therebetween at each pair 34 for receiving a portion of the printed circuit board 16 (see FIG. 4). In this embodiment the connector has a single row of the contacts 22. However, in alternate embodiments different arrays or configurations of the contacts could be provided. The contacts 22 are preferably fixedly mounted to the housing 18 by insertion into the contact channels 26 using known techniques. Front ends of the contacts 22 are located in the plug receiving area 24 to mate with contacts on the plug. Rear ends of the contacts 22 extend from the rear end of the housing 18 and are secured to contact areas 42 (see FIG. 4) on the printed circuit board 16. Although FIG. 2 shows surface mount tails, other terminations (e.g.: press-fit or pin-in-paste) could also be used to mount the connector to the board 16. The front edge 44 (see FIG. 4) of the printed circuit board 16 is located at the rear end 30 of the housing 18 with the board 16 extending through the receiving areas 40 between the legs 36 when assembly 10 is assembled. Front lateral sections 46 are supported on the extensions 38. As seen in FIG. 4, the board 16 has two notches 47 at opposite lateral sides of the board behind the front lateral sections 46. The legs 36 support the board 16 on both opposite lateral sides of the board. However, the connector could have a different shaped housing or contacts. The printed circuit board could also be any suitable type of electronic component. The connector housing is designed to mount adjacent the leading or front edge of the printed circuit board. While the extended legs 36 on the backside of the housing support the connector on both lateral sides of the board, legs 36 also protect the rear end tails of the contacts. Blocks 38 that extend from the side of the legs are designed for locking the connector assembly to the pair of protective cover members 70, 72 of the cover 14. Blocks 38 fit into corresponding openings (not shown) in the cover members 70,72. The cover 14 protects the components on the printed circuit board as well as the contact tails.

The shield 20 is preferably stamped and formed from a sheet of suitable conductive material, such as stainless steel, with known techniques. Shield 20 helps reduce electromagnetic interference (EMI). The shield 20 includes a front 48, a top 50, a bottom 52, and two sides 54. The front 48 has a hole 56. The hole 56 leads into the plug receiving area 24 and allow entry of the plug connector. The shield also has spring fingers 58 that extend from the hole 56 into the plug receiving area 24. These spring fingers 58 preferably make electrical contact with an exterior shield on a mating electrical connector (not shown) inserted into the connector 12. The shield 20 and top recess 29 of the housing 18 also form a latch engagement area for the mating connector similar to the connectors described in the U.S. Pat. No. 5,865,646.

The rear end of the bottom 52 of the shield 20 has an upturned tab 60 to help retain the shield on the housing 18. The two sides 54 of the shield 20 have integral cantilevered latches 62. The latches 62 are located at the side recesses 28 of the housing 18. Latches 62 help retain assembly 10 in, for example, a rail frame (not shown) mounted to a PCB (not shown) in a network server (not shown). Recesses 28 are sized to allow latches 62 to flex therein during insertion into the rail frame, but prevent overstress by allowing the latches 62 to bottom out on the floors of recesses 28. Since latches 62 are part of shield 20, latches 62 provide additional points of contact between shield 20 and the rail frame, which helps improve EMI performance. Removal of assembly 10 from the rail frame can be achieved by depressing tab 62*a*, which deflects latch 62 into recess 28 and out of engagement with the rail frame.

The shield 20 further comprises two arms 64. The arms 64 extend from the rear end of the top 50. The arms 64 extend into the top recesses 32 of housing 18 to help retain the shield 20 on the housing 18. The distal ends 66 of the arms 64 extend down to the area that receives the printed circuit board 16. With the board 16 engaging the connector 12, the ends 66 can be located in the notches 47 of the board to help retain the mechanical connection of the board with the connector. In an alternate embodiment, the ends 66 could be soldered to the board 16 and joined to a ground. When the board 16 is initially inserted into the receiving areas 40, the arms 64 can resiliently deflect to allow the front lateral sections 46 to pass by the arms 64. The arms 64 can then resile and snap into the notches 47 and precisely locate the contact areas 42 relative to the rear ends of the contacts 22 for soldering; inner edges 45 of the board cooperating with inner edges 65 of the arms 64. In alternate embodiments more or less than two of the arms 64 could be provided and the arms 64 could extend from any suitable side of the shield. The sides 54 of shield 20 could also wrap around onto the rear end of the housing 18. The latches 62 substantially cover the side of the housing 18 at the side recesses 28. Thus, the shield 20 generally surrounds the entire housing 18 except at the front hole 56 and at the rear end of the housing. The metal shield is designed to completely wrap around the connector housing and provide EMI shielding for the connector assembly. Thus, this design provides adequate surface to surface contact along the entire length of the of the connector assembly.

The cover 14 generally comprises two members 70, 72 which are fixedly connected to each other with the printed circuit board 16 being located between the two cover members. Preferably the cover members 70, 72 have portions which are electrically conductive or are entirely from conductive material. Cover 14 preferably comprises grooves 76 along opposed side walls that engage corresponding features on the rail frame. The cover 14 also preferably comprises holes 80 for cooling the electronic components on the printed circuit board 16 located within the cover 14. Although shown on the top wall 78, holes 80 could be located anywhere on cover 14. Cover members 70,72 are preferably snap-lock connected to each other. The cover 14 has a front end that is adjacent to the electrical connector 12. Preferably, the electrically conductive portion of the cover 14 is contacted by the shield for grounding purposes, such as by abutting the portions of shield 20 adjacent or bent around the rear edge of the housing 18.

The present invention offers complete shielding around the connector. The latch mechanism is part of the shield and enhances the shield effectiveness of the connector. The shield is designed with a pair of arms, which extend out the back of the connector. These arms position and hold together the printed circuit board to the connector assembly. Extensions off the arms allow for connection to an electrical ground on the printed circuit board if required.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A connector assembly comprising:

a housing having a first end and a second end opposite said first end, said first end having a plug receiving opening therein, said housing further comprising a printed circuit board receiving area extending into the housing from said second end of the housing, portions of the housing bordering top and bottom sides o£ the receiving area, wherein a printed circuit board is insertable into and supportable by the housing in the receiving area;

an electrical contact connected to the housing and mountable to the printed circuit board; and a shield connected to the housing, the shield comprising an aperture overlying said plug receiving opening of said housing and at least one arm which extends from the shield towards said second end of said housing, the arm retaining the shield on the housing and engaging the printed circuit board when said printed circuit board is inserted into said second end of said housing, wherein the housing includes legs with an open area between the legs for receiving the printed circuit board, wherein the legs are adapted to contact and support the printed circuit board on opposite sides of the printed circuit board.

2. An electrical connector comprising:

an enclosed housing having a plug receiving opening and a receiving area inside said enclosed housing for receiving an edge of a printed circuit board, said receiving area comprising arms of the housing on opposite top and bottom sides of the receiving area for contacting and supporting top and bottom sides of the printed circuit board therebetween;

an electrical contact mounted to the housing; and a shield substantially surrounding the housing, the shield having an aperture overlying said plug receiving opening, wherein the receiving area of said housing comprises arms inside of the housing and on opposite top and bottom sides of the receiving area for contacting and supporting top and bottom sides of the printed circuit board.

* * * * *